US009896802B2

(12) United States Patent
Millward

(10) Patent No.: US 9,896,802 B2
(45) Date of Patent: Feb. 20, 2018

(54) CREPING BLADE AND METHOD FOR ITS MANUFACTURING

(71) Applicant: voestalpine Precision Strip AB, Munkfors (SE)

(72) Inventor: Chris Millward, Forshaga (SE)

(73) Assignee: VOESTALPINE PRECISION STRIP AB, Munkfors (SE)

( * ) Notice: Subject to any disclaimer, the term of this patent is extended or adjusted under 35 U.S.C. 154(b) by 0 days.

(21) Appl. No.: 15/112,008

(22) PCT Filed: Jan. 17, 2015

(86) PCT No.: PCT/SE2015/050013

§ 371 (c)(1),
(2) Date: Jul. 15, 2016

(87) PCT Pub. No.: WO2015/108469

PCT Pub. Date: Jul. 23, 2015

(65) Prior Publication Data

US 2016/0333523 A1 Nov. 17, 2016

(30) Foreign Application Priority Data

Jan. 17, 2014 (EP) ..... 14151659

(51) Int. Cl.

| | |
|---|---|
| ***C22C 38/22*** | (2006.01) |
| ***D21G 3/04*** | (2006.01) |
| ***B31F 1/14*** | (2006.01) |
| ***C21D 6/00*** | (2006.01) |
| ***C21D 9/18*** | (2006.01) |
| ***C22C 38/00*** | (2006.01) |
| ***C22C 38/02*** | (2006.01) |
| ***C22C 38/04*** | (2006.01) |
| ***C22C 38/24*** | (2006.01) |
| ***C21D 9/58*** | (2006.01) |
| ***C21D 1/25*** | (2006.01) |
| ***B22F 3/15*** | (2006.01) |
| ***B22F 3/24*** | (2006.01) |
| ***B22F 9/08*** | (2006.01) |
| ***C21D 1/18*** | (2006.01) |
| ***C21D 1/56*** | (2006.01) |
| ***C21D 8/02*** | (2006.01) |
| ***C21D 9/22*** | (2006.01) |
| ***C21D 9/52*** | (2006.01) |
| *B22F 5/00* | (2006.01) |

(52) U.S. Cl.

CPC ..... *D21G 3/04* (2013.01); *B22F 3/15* (2013.01); *B22F 3/24* (2013.01); *B22F 9/082* (2013.01); *B31F 1/145* (2013.01); *C21D 1/18* (2013.01); *C21D 1/25* (2013.01); *C21D 1/56* (2013.01); *C21D 6/002* (2013.01); *C21D 8/0205* (2013.01); *C21D 8/0226* (2013.01); *C21D 8/0236* (2013.01); *C21D 8/0247* (2013.01); *C21D 9/18* (2013.01); *C21D 9/22* (2013.01); *C21D 9/52* (2013.01); *C21D 9/58* (2013.01); *C22C 38/001* (2013.01); *C22C 38/02* (2013.01); *C22C 38/04* (2013.01); *C22C 38/22* (2013.01); *C22C 38/24* (2013.01); *B22F 2003/248* (2013.01); *B22F 2005/001* (2013.01); *B22F 2009/0824* (2013.01); *C21D 2211/008* (2013.01)

(58) Field of Classification Search

None

See application file for complete search history.

(56) References Cited

U.S. PATENT DOCUMENTS

| | | | | |
|---|---|---|---|---|
| 6,207,021 | B1 | 3/2001 | Eriksson et al. | |
| 7,297,177 | B2 * | 11/2007 | Sandberg | C22C 38/04 148/334 |
| 7,722,697 | B2 | 5/2010 | Daxelmuller et al. | |
| 2008/0096037 | A1 | 4/2008 | Daxelmuller et al. | |

FOREIGN PATENT DOCUMENTS

| | | | |
|---|---|---|---|
| EP | 2423345 | A1 | 2/2012 |
| WO | WO 8807093 | | 9/1988 |
| WO | WO 03000944 | A1 | 1/2003 |
| WO | WO 2012128700 | A1 | 9/2012 |

OTHER PUBLICATIONS

International Search Report and Written Opinion dated Mar. 16, 2015, for International Patent Application No. PCT/SE2015/050013.

* cited by examiner

*Primary Examiner* — Mark Halpern
(74) *Attorney, Agent, or Firm* — Karceski IP Law, PLLC

(57) ABSTRACT

The invention relates to a creping blade for the detachment of a travelling paper web from a dryer cylinder, said blade having a working edge to be placed against the cylinder, wherein the creping blade has a tensile strength of 1800-2500 N/mm$^2$ and a hardness of 57-66 HRC in the hardened and tempered condition and wherein the blade is made from a steel, which comprises the following main components (in wt. %): C: 1.2-1.5; Si: 0.1-0.8; Mn: 0.1-0.7; Cr: 4.2-5.2; Mo: 3.0-4.0; V: 3.2-4.2; N: 0.01-0.15; balance Fe and impurities.

18 Claims, 1 Drawing Sheet

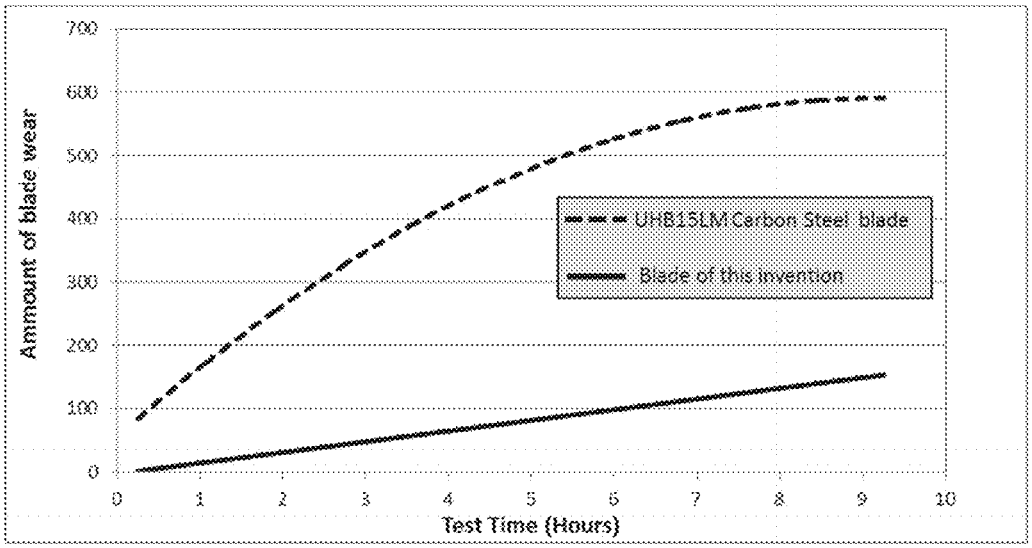
Result of comparative simulated creping wear tests

CREPING BLADE AND METHOD FOR ITS MANUFACTURING

CROSS-REFERENCE TO RELATED APPLICATIONS

This is a National Stage Entry into the United States Patent and Trademark Office from International PCT Patent Application No. PCT/SE2015/050013, having an international filing date of Jan. 12, 2015, which claims priority to European Patent Application No. 14151659.1, filed Jan. 17, 2014, the entire contents of both of which are incorporated herein by reference.

TECHNICAL FIELD

The invention relates to a creping blade for the detachment of a travelling paper web from a dryer cylinder. The creping blade is made of a cold rolled steel having a high tensile strength and a high hardness.

BACKGROUND OF THE INVENTION

In the paper industry, creping blades are used for the manufacture of tissue. Creping blades may be made of different materials such as steels, ceramics, composites and polymers. In addition, different types of coating may be applied in order to reinforce the working edge of the creping blade such as described in U.S. Pat. No. 6,207,021 B1. Compositions of steel alloys, which may be used for creping blades are listed in WO2012/128700 A1. US 2008/0096037 discloses a creping blade manufactured from a PM-steel comprising 1-3% C, 4-10% Cr, 1-8% Mo and 2.5-10% V.

SUMMARY OF THE INVENTION

An object of the present invention is to provide a creping blade of steel having an improved lifetime. A further object is to provide a method of manufacturing such a creping blade.

The foregoing objects, as well as additional advantages are achieved to a significant measure by making the creping blade from a cold work tool steel with a carefully balanced composition as set out in the claims as well as by subjecting the cold rolled steel strip used for the creping blade to a specific continuous hardening and tempering treatment.

BRIEF DESCRIPTION OF THE DRAWING(S)

The present invention will now be described in connection with the drawing appended hereto, in which:

FIG. 1 is a graph plotting amount of blade wear against time.

DETAILED DESCRIPTION

Below the importance of the separate elements and their interaction with each other as well as the limitations of the chemical ingredients of the claimed alloy are briefly explained. All percentages for the chemical composition of the steel are given in weight % (wt. %) throughout the description.

Carbon is to be present in an amount of 1.2-1.5 wt. %, preferably 1.3-1.4 wt. % so that the steel will get the desired hardness and strength. Carbon also contributes to a good wear resistance by forming M(C,N), where M is vanadium, in the first place and other metals such as Mo in the second place.

Silicon shall be present in the steel in an amount of between 0.1-0.8 wt. %, preferably 0.2-0.6 wt. %. Silicon increases the carbon activity. By keeping the content of silicon low, it is possible to keep the carbon activity low in order to avoid or minimize the precipitation of undesired chromium-rich $M_{23}C_6$ particles.

Manganese contributes to give the steel the desired hardenability.

Chromium shall be present in the steel in an amount between 4.2 and 5.2 wt. % in order to give the steel a good hardenability. Cr also adds to the oxidation resistance of the alloy. However, chromium may form undesirable carbides.

Molybdenum is known to have a very favourable effect on the hardenability. Mo shall be present in the steel in an amount between 3.0 and 4.0 wt. %, preferably 3.3-3.7 wt. %.

Molybdenum is a carbide forming element. The balanced Mo content of the present invention results in a very low amount of primary $M_6C$-carbides and in a high amount of molybdenum containing M(C,N).

Vanadium is favourable for the tempering resistance and the wear resistance of the steel, as it together with carbon form comparatively round, evenly distributed primary precipitated M(C,N) in the matrix of the steel. In the steels used for the inventive blade M is mainly V, Mo and Cr. Vanadium shall therefore be present in a content of 3.2-4.2 wt. %, preferably 3.5-3.9 wt. %. In connection with the hardening, the primarily precipitated M(C,N)-particles will be dissolved to a certain extent depending on the austenitizing temperature At the subsequent tempering, very small vanadium-rich secondary particles of the M(C,N)-type are precipitated instead. The blade has a matrix consisting of tempered martensite containing small primary carbides of the M(C,N)-type and a high number of very small, evenly distributed secondarily precipitated M(C,N), when used for the detachment of a travelling paper web from a dryer cylinder steel.

Nitrogen is present in an amount of 0.01-0.15 wt. %. For this reason carbo-nitrides M(C,N) may form. These will be partly dissolved during the austenitizing step and then precipitated during the tempering step as particles of nanometer size. The thermal stability of vanadium carbo-nitrides is considered to be better than that of vanadium carbides, hence the tempering resistance of the steel may be improved. Further, by tempering at least twice, the tempering curve will have a higher secondary peak.

Tungsten. In principle, molybdenum may be replaced by twice as much tungsten. However, tungsten is expensive and it also complicates the handling of scrap metal. The maximum amount is therefore limited to 0.5 wt. % and most preferably no additions are made.

Copper is an element, which may contribute to increasing the hardness of the steel. Cu may be present in an amount of up to 0.5 wt. %. However, copper may negatively influence the hot ductility of the steel. Further, it is not possible to extract copper from the steel once it has been added. This drastically makes the scrap handling more difficult. For this reason, copper shall preferably not be deliberately added. The impurity content is preferably limited to 0.25 wt. %.

Aluminium may be used for deoxidation of the steel. However, if the steel is produced by melt atomizing, then no deliberate addition of Al is made.

Boron may be added in an amount of ≤0.01 wt. %, preferably 0.0005-0.003 wt. % to further increase the hardenability.

Nickel and cobalt may be present in an amount of up to 3 wt. % each. They increase the hardenability but are expensive. A deliberate addition of these elements are therefore not necessary.

Niobium can in principle be used to replace part of the vanadium. However, Nb is not as efficient as V in that it has an atomic weight nearly twice that of V. Accordingly, Nb is normally not deliberately added.

Ti, Zr and Hf are elements, which form cubic carbides in the steel. However, these elements need not be present in the steel.

P, S and O are impurities, which may be present in the steel alloy. Allowable contents are P≤0.03, S≤0.03 and O≤0.015.

REM as well as Ca and Mg may be used for sulphur removal or modification of sulphide inclusions. REM may be present in an amount of up to 0.2 wt. %. Mg and Ca may be present in an amount of 0.01 wt. % each. These contents may be considered as impurity contents.

The creping blade of the present invention is used in the hardened and tempered condition. It has a tensile strength of 1800-2500 N/mm$^2$, preferably 1900-2400 N/mm$^2$ and a hardness of 57-66 HRC, preferably 57-64 HRC. The reasons for these high values are the balanced steel composition in combination with the heat treatment, which results in a relatively high amount of small and uniformly distributed primary M(C,N)-particles and a very high number of nano-sized secondary precipitated M(C,N)-particles in a tempered martensitic matrix.

The austenitizing temperature is 950-1100° C., preferably 1000-1040° C. The tempering temperature is 500-650° C., preferably 610-630° C.

During austenitizing, part of the primary M(C,N)-particles will dissolve to a certain extent resulting in a martensitic matrix, which comprises 0.3-0.7% C, preferably 0.4-0.6% C, directly after hardening. One reason for the high dissolved carbon content may be seen in the fact that nitrogen in the steel alloy partly replaces carbon in the M(C,N)-particles. Hence, during tempering there will be a massive precipitation of secondary nano-sized M(C,N)-particles resulting in an increased tensile strength and hardness. Another reason may be seen in the fact that all carbides of the type $M_{23}C_6$, $M_7C_3$ and $M_6C$ will dissolve during austenitizing. Hence, the content of Mo dissolved in the matrix will be increased and nano-sized Mo-rich $M_2C$-particles and Mo-containing M(C,N)-particles may be formed during tempering. The precipitation of these very fine secondary carbides results in a marked secondary hardening effect resulting in a hardness value of 57-66 HCR and an enhanced wear resistance.

Example

A steel melt having the composition given below was subjected to gas atomizing and HIP-ing.

C 1.43
Si 0.38
Mn 0.43
Cr 4.68
Mo 3.55
V 3.73
N 0.05
balance Fe and impurities.

The steel was subjected to hot rolling to a thickness 2.75 mm and was cold rolled to a thickness of 1.25 mm in order to develop a superior surface finish. The cold rolled steel was subjected to a continuous hardening at an average austenitizing temperature of 1020° C. Quenching occurred initially in a molten lead bath held at 320±10° C. to get an even temperature distribution and then using water cooled plates to bring the material to room temperature whilst achieving the required high level of flatness. Low speed continuous tempering at 620° C. occurred twice with cooling to room temperature necessary between tempers.

The creping blade had a tensile strength of 1930 N/mm$^2$, an elongation A50 of 5% and a hardness of 58 HRC. The working edge had a hardness of 650 HV1.

The wear resistance was evaluated in side-by-side tests on a machine that simulates wear in a creping operation. The inventive steel blade was compared to a traditional UHB 15LM carbon steel blade (0.75% C, 0.2% Si, 0.73% Mn). The result is shown in FIG. 1. This FIGURE reveals not only that the total wear of the inventive blade is roughly 25% of the standard steel blade but also that the wear is much more linear, which is important for users so that their intervention during operation is minimized.

Hence, as a rule of thumb the service life of the inventive blade can be estimated to be at least four times that of a conventional blade.

The invention claimed is:

1. A creping blade for the detachment of a travelling paper web from a dryer cylinder, the creping blade having a working edge to be placed against the dryer cylinder, wherein the creping blade has a tensile strength of 1800-2500 N/mm$^2$ and a hardness of 57-66 HRC in the hardened and tempered condition, wherein the working edge has a hardness of 630-720 HV1, and wherein the creping blade is made from a cold rolled steel with a steel composition consisting of, in weight % (wt. %):

C 1.2-1.5
Si 0.1-0.8
Mn 0.1-0.7
Cr 4.2-5.2
Mo 3.0-4.0
V 3.2-4.2
N 0.01-0.15
optionally
Cu≤0.5
Al≤0.06
W≤0.5
Ni≤3
Co≤3
Nb≤1
Ti≤0.1
Zr≤0.1
Hf≤0.1
B≤0.01
REM≤0.2
Ca≤0.01
Mg≤0.01
P≤0.03
S≤0.03
O≤0.015
balance Fe and impurities.

2. The creping blade according to claim 1, wherein the steel composition fulfils at least one of the following conditions (in wt. %):

C 1.3-1.4
Si 0.2-0.6
Mn 0.2-0.6
Cr 4.4-5.0
Mo 3.3-3.7
V 3.5-3.9
N 0.02-0.12
Cu 0.05-0.25.

3. The creping blade according to claim 1, wherein the creping blade has a thickness of 1.0-3.0 mm.

4. The creping blade according to claim 3, wherein the creping blade has a thickness of 1.2-2.0 mm.

5. The creping blade according to claim 3, wherein the creping blade has a thickness of 1.25 to 1.8 mm.

6. The creping blade according to claim 1, wherein the creping blade has a tensile strength of hardness of 1900-2400 $N/mm^2$ and a hardness of 57-64 HRC in the hardened and tempered condition.

7. The creping blade according to claim 1, wherein a martensitic matrix of the cold rolled steel prior to tempering comprises 0.3-0.7% C.

8. The creping blade according to claim 7, wherein the martensitic matrix prior to tempering comprises 0.4-0.6% C.

9. The creping blade according to claim 1, wherein the cold rolled steel is produced by melt atomizing and compaction.

10. The creping blade according to claim 1, wherein the steel composition fulfils at least one of the following conditions (in wt. %):

Ni≤1
Co≤1
Nb≤0.3
Ti≤0.01
Zr≤0.01
Hf≤0.01
B≤0.003
REM≤0.05
Al≤0.03
N 0.02-0.10.

11. The creping blade according to claim 10, wherein the steel composition fulfils at least one of the following conditions (in wt. %):

Ni≤0.3
Co≤0.3
Nb≤0.1
B≤0.0005
REM≤0.01
Al≤0.01
N 0.03-0.08.

12. The creping blade according to claim 1, wherein the steel composition does not have any deliberate addition of any of the optional elements.

13. A method for the manufacturing of the creping blade according to claim 1, comprising:

a) providing a hot rolled steel strip having the steel composition,
b) cold rolling the hot rolled strip to a final thickness, and
c) continuously hardening and tempering the cold rolled strip to produce a hardened strip.

14. The method for the manufacturing of the creping blade according to claim 13, wherein the hardened strip is subjected to multiple tempering treatments.

15. The method according to claim 13, wherein an austenitizing temperature is 950-1100° C. and a tempering temperature is 500-650° C.

16. The method according to claim 15, wherein the austenitizing temperature is 1000-1040° C. and the tempering is performed twice at 610 to 630° C.

17. The method according to claim 13, wherein the hardening involves quenching in a bath of molten lead or lead alloy, held at a temperature of 310-340° C.

18. A creping blade for the detachment of a travelling paper web from a dryer cylinder, the creping blade having a working edge to be placed against the dryer cylinder, the creping blade being formed from a cold rolled strip made from a steel having a microstructure resulting from austenitizing at an austenitizing temperature of 1000-1040° C., hardening by quenching in a bath of molten lead or lead alloy at a temperature of 310-340° C., and tempering twice at a tempering temperature of 610-630° C., the creping blade having a tensile strength of 1800-2500 $N/mm^2$ and a hardness of 57-66 HRC in the hardened and tempered condition, the working edge having a hardness of 630-720 HV1, and the steel having composition consisting of, in weight % (wt. %):

C 1.2-1.5
Si 0.1-0.8
Mn 0.1-0.7
Cr 4.2-5.2
Mo 3.0-4.0
3.2-4.2
N 0.01-0.15
Cu 0.05-0.25
balance Fe and impurities.

* * * * *